US007855359B2

(12) United States Patent
Yamada et al.

(10) Patent No.: US 7,855,359 B2
(45) Date of Patent: Dec. 21, 2010

(54) MASS SPECTROMETER EQUIPPED WITH MALDI ION SOURCE AND SAMPLE PLATE FOR MALDI ION SOURCE

(75) Inventors: Shintarou Yamada, Tokyo (JP); Nobuo Kudou, Tokyo (JP); Takaya Sato, Tokyo (JP)

(73) Assignee: JEOL Ltd., Tokyo (JP)

( * ) Notice: Subject to any disclaimer, the term of this patent is extended or adjusted under 35 U.S.C. 154(b) by 236 days.

(21) Appl. No.: 12/197,565

(22) Filed: Aug. 25, 2008

(65) Prior Publication Data

US 2009/0057552 A1 Mar. 5, 2009

(30) Foreign Application Priority Data

Aug. 27, 2007 (JP) ..... 2007-219160

(51) Int. Cl.
*H01J 49/00* (2006.01)

(52) U.S. Cl. ..... 250/288; 250/281; 250/282; 250/287

(58) Field of Classification Search ..... 250/281, 250/282, 287, 288; 40/299.01
See application file for complete search history.

(56) References Cited

U.S. PATENT DOCUMENTS

| | | | | |
|---|---|---|---|---|
| 5,498,545 | A * | 3/1996 | Vestal | 436/47 |
| RE37,485 | E * | 12/2001 | Vestal | 436/47 |
| 6,730,517 | B1 * | 5/2004 | Koster et al. | 436/47 |
| 6,940,065 | B2 * | 9/2005 | Graber et al. | 250/282 |
| 7,109,481 | B1 * | 9/2006 | Zanon et al. | 250/288 |
| RE39,353 | E * | 10/2006 | Vestal | 436/47 |
| 2003/0213905 | A1 * | 11/2003 | Lennon et al. | 250/288 |
| 2003/0213906 | A1 * | 11/2003 | Lennon et al. | 250/288 |
| 2004/0108452 | A1 * | 6/2004 | Graber et al. | 250/281 |
| 2004/0113066 | A1 | 6/2004 | Berlin | |
| 2005/0031496 | A1 | 2/2005 | Laurell et al. | |
| 2005/0045815 | A1 * | 3/2005 | Bui | 250/282 |
| 2006/0121599 | A1 * | 6/2006 | Reihs | 435/287.1 |
| 2007/0051899 | A1 * | 3/2007 | Truche et al. | 250/423 P |
| 2008/0149822 | A1 * | 6/2008 | Vertes et al. | 250/282 |

FOREIGN PATENT DOCUMENTS

| | | |
|---|---|---|
| JP | 2003-043014 | 2/2003 |
| JP | 2003-534634 | 11/2003 |
| JP | 2004-347524 | 12/2004 |
| JP | 2005-513490 A | 5/2005 |

* cited by examiner

*Primary Examiner*—Robert Kim
*Assistant Examiner*—Michael Maskell
(74) *Attorney, Agent, or Firm*—The Webb Law Firm

(57) ABSTRACT

A mass spectrometer is equipped with a MAILDI ion source facilitating both individual management of sample plates and mass calibration based on information about distortion in the sample plates. Also, sample plates adapted to be used in the MALDI ion source are provided. Identification information about each sample plate and information about distortion, i.e., topography, in the surface of the sample plate are engraved on the surface of the sample plate. These sets of information are also registered as an electronic file. During measurement, these sets of information are read by observation means and used for individual management of sample plates and mass calibration of mass spectra.

9 Claims, 3 Drawing Sheets

MASS SPECTROMETER EQUIPPED WITH MALDI ION SOURCE AND SAMPLE PLATE FOR MALDI ION SOURCE

BACKGROUND OF THE INVENTION

1. Field of the Invention

The present invention relates to a mass spectrometer equipped with a MALDI (matrix-assisted laser desorption/ionization) ion source used when biopolymers and other samples are analyzed qualitatively or quantitatively.

2. Description of Related Art

A MALDI process is a method of vaporizing or ionizing a sample by mixing the sample into a matrix (liquid, crystalline compound, or metal powder) having an absorption band in the wavelength of the used laser light, dissolving and solidifying the matrix, and irradiating the matrix with the laser light. In a laser ionization method typified by a MALDI process, the initial energies during ion creation are distributed in a wide range. Accordingly, in order to converge the distribution in terms of time, delay extraction is employed in most cases. In this method, a pulser voltage is applied with a delay of hundreds of nanoseconds after laser irradiation.

The general concept of delay extraction applied to a MALDI ion source is shown in FIG. 4. An analyte is mixed into a matrix (liquid, crystalline compound, or metal powder), and the mixture is dissolved and solidified, thus preparing a sample 12. The sample 12 is placed on a sample plate 11. To permit the state of the sample 12 to be observed, a lens 16, a mirror 15, and a CCD camera 17 are arranged. Laser light is directed at the sample through another lens 13 and another mirror 14, thus vaporizing or ionizing the sample. The created ions are accelerated by voltages applied to an intermediate electrode 18 and to a base electrode 19, respectively. The accelerated ions are introduced into a TOF (time-of-flight) mass analyzer (not shown).

A sequence of operations for measuring the flight time in the delay extraction is also shown in FIG. 4. First, the intermediate electrode 18 and sample plate 11 are placed at the same potential of Vs. Then, the potential Vs at the intermediate electrode 18 is varied to potential V1 at high speed with a delay of hundreds of nanoseconds since reception of a signal from a laser (not shown) that indicates laser oscillation. Consequently, a potential gradient is created between the sample plate 11 and the intermediate electrode 18 to accelerate the created ions. The time at which the flight time is started to be measured is synchronized with the time of start of variation of the voltage applied to the intermediate electrode.

Because the flight time of the ions is determined by the strength of the accelerating electric field produced between the sample plate 11 and the intermediate electrode 18, the distance between the sample plate 11 and the intermediate electrode 18 must be exactly the same at all times irrespective of the position on the sample plate 11.

In a mass spectrometer using a MALDI process in the ion source, the sample plate 11 is generally made of a conductive material, such as stainless steel, in order to produce an electric field that extracts ions created by laser irradiation. Marks are engraved on the surface of the conductive sample plate 11 to indicate the positions into which the sample is dripped. The number of the engraved marks is generally 96 (12 rows×8 columns), 384 (24 rows×16 columns), or 1536 (48 rows×32 columns).

In use, the sample plate 11 having the engraved marks into which the sample 12 has been dripped is introduced into the mass analyzer. The droplets of the sample 12 are irradiated with laser light while observing the surface of the sample plate 11 with the CCD camera 17. Thus, the sample is ionized.

Consequently, a mass analysis is performed. See, JP-A-2003-43014, JP-T-2003-534634, JP-A-2004-347524, and JP-T-2005-513490.

However, where a measurement is performed using plural sample plates each having many engraved round marks for sample, some problems may take place. In particular, it is not known what of the samples is being measured. It is not known what sample is being dripped onto what sample plate. It is impossible to find the relationship between the used sample plate and the data obtained by the measurement.

Furthermore, where sample plates are stocked under the condition in which a sample has been dripped, it is necessary to manage the sample plates individually in order to prevent the measurer from using an erroneous sample plate.

In addition, the surface of each sample plate is uneven and produces distortion. The distortion is on the order of ±0.1 mm but may affect the mass resolution and the mass axis, making it impossible to obtain correct mass spectra. Consequently, it is necessary to make a mass calibration based on information about the distortion.

SUMMARY OF THE INVENTION

It is an object of the present invention to provide a MALDI ion source capable of facilitating both individual management of sample plates and mass calibration based on information about distortion of the sample plates. It is another object of the present invention to provide a sample plate for use in the MALDI ion source.

A mass spectrometer which is equipped with a MALDI ion source and which is built in accordance with one embodiment of the present invention performs mass analysis by causing spots of a sample to adhere at different locations on a surface of a sample plate, irradiating the spots of the sample with laser light in turn to ionize the spots of the sample, introducing the obtained sample ions into a mass analyzer to obtain mass spectra, and processing data derived from the mass spectra by means of a data-processing portion. A code or mark indicating identification information about the sample plate is formed on the surface of the sample plate such that the code or mark can be read by means of reading means. The identification information about the sample plate read by the reading means is combined with the mass spectra and stored in memory.

In another feature of the present invention, the reading means acts also as observation means for observing the spots of the sample adhering at the different locations on the surface of the sample plate.

In a further feature of the present invention, the mass spectra obtained from the spots of the sample adhering at the different locations on the surface of the sample plate are calibrated in terms of mass by previously registering the identification information about the sample plate and information about topography of the surface of the sample plate into a storage device incorporated in the mass spectrometer while the identification information and the information about the topography are made to correspond to each other, reading the information about the topography of the surface of the sample plate from the storage device based on the identification information about the sample plate read by the reading means to find information about the heights of the locations at which the spots of the sample adhere, and calibrating the mass spectra in terms of mass based on the found information about the heights.

In yet another feature of the present invention, codes or marks indicating the information about the topography of the surface of the sample plate are formed on the surface of the sample plate such that the codes or marks can be read by the reading means. Based on the information about the topography of the surface of the sample plate read by the reading means, information about the heights of the locations at which the spots of the sample adhere is found. Based on the found information about the heights, the mass spectra obtained from the spots of the sample adhering at the different locations on the surface of the sample plate are calibrated in terms of mass.

Furthermore, the present invention provides a mass spectrometer equipped with a MALDI ion source and designed to perform mass analysis by causing spots of a sample to adhere at different locations on a surface of a sample plate, to irradiate the spots of the sample with laser light in turn to ionize the spots of the sample, to introduce the obtained sample ions into a mass analyzer, to obtain mass spectra of the spots of the sample, and to process data derived from the mass spectra by a data-processing portion. Codes or marks indicating information about the topography of the surface of the sample plate are formed on the surface of the sample plate. Reading means for reading the codes or marks is mounted. The data-processing portion calibrates the mass spectra obtained from the spots of the sample adhering at the different locations on the surface of the sample plate in terms of mass, based on the information about the topography of the surface of the sample plate read by the reading means.

In an additional feature of the present invention, the data-processing portion finds information about the heights of the locations at which the spots of the sample adhere, based on the information about the topography of the surface of the sample surface read by the reading means and calibrates the mass spectra based on corresponding sets of the found information about the heights.

In still another feature of the present invention, a code or mark indicating identification information about the sample plate is formed on the surface of the sample plate such that the code or mark can be read by the reading means. The mass spectra are combined with the identification information about the sample plate read by the reading means and stored in memory.

Additionally, the present invention provides a sample plate which is for use in a mass spectrometer equipped with a MALDI ion source. The sample plate has marks indicating positions at which spots of a sample are made to adhere and a code or mark indicating identification information about the sample plate.

Moreover, codes or marks indicating information about the topography of the surface of the sample plate are formed.

A barcode or QR code (quick response code) can be used as the code indicating the identification information about the sample plate and as the codes indicating the information about the topography of the surface of the sample plate.

A MALDI ion source according to the present invention is for use in a mass spectrometer that performs mass analysis by causing spots of a sample to adhere at different locations on a surface of a sample plate, irradiating the spots of the sample with laser light in turn to ionize the spots of the sample, introducing the obtained sample ions into a mass analyzer to obtain mass spectra, and processing data derived from the mass spectra by a data-processing portion. A code or mark indicating identification information about the sample plate is formed on the surface of the sample plate such that the code or mark can be read by reading means. The identification information about the sample plate read by the reading means is combined with the mass spectra and stored in memory. In consequence, a MALDI ion source and sample plates can be offered which facilitate both individual management of the sample plates and mass calibration based on information about distortion in the sample plates.

The above-described mass spectrometer according to the present invention is equipped with a MALDI ion source and designed to perform mass analysis by causing spots of a sample to adhere at different locations on a surface of a sample plate, to irradiate the spots of the sample with laser light in turn to ionize the spots of the sample, to introduce the obtained sample ions into a mass analyzer, to obtain mass spectra of the spots of the sample, and to process data derived from the mass spectra by a data-processing portion. Codes or marks indicating information about the topography of the surface of the sample plate are formed on the surface of the sample plate. Reading means for reading the codes or marks is mounted. The data-processing portion calibrates the mass spectra obtained from the spots of the sample adhering at the different locations on the surface of the sample plate in terms of mass, based on the information about the topography of the surface of the sample plate read by the reading means. Hence, a MALDI ion source and sample plates can be offered which facilitate both individual management of the sample plates and mass calibration based on information about distortion in the sample plates.

The sample plate, according to the present invention, is for use in a MALDI ion source and has marks indicating positions at which spots of a sample are made to adhere and a code or mark indicating identification information about the sample plate. As a consequence, a MALDI ion source and sample plates can be offered which facilitate both individual management of the sample plates and mass calibration based on information about distortion in the sample plates.

These and other objects and advantages of the present invention will become more apparent as the following description proceeds.

DESCRIPTION OF THE PREFERRED EMBODIMENTS

Figure 1B:
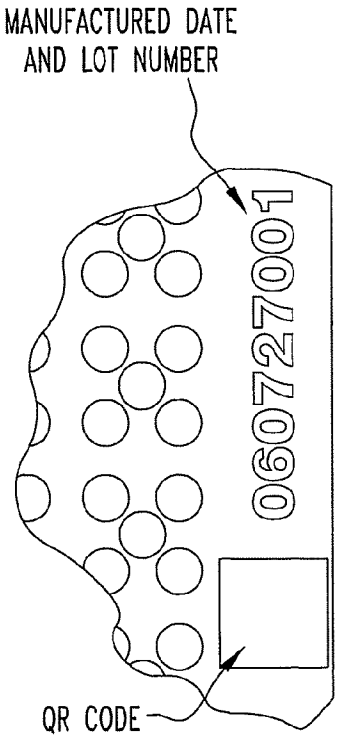
FIG. 1 is a plan view of a sample plate, according to the present invention, also showing a part of the plate on an enlarged scale.
Figure 1A:
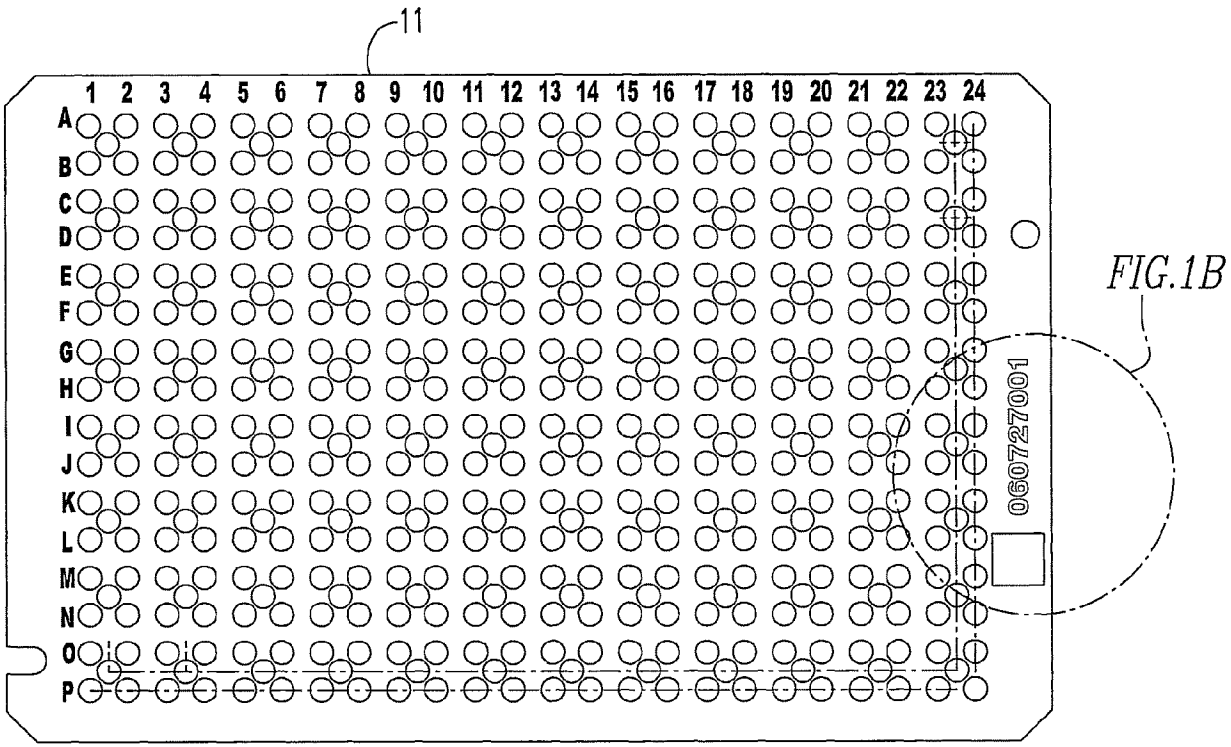

The preferred embodiments of the present invention are hereinafter described with reference to the drawings. FIG. 1 shows a sample plate, according to the present invention, the plate being for use in a MALDI ion source.

The sample plate is made of stainless steel. 384 (16 columns (A-P) and 24 rows (1-24)) round marks for accepting the dropping of a sample have been engraved by light emitted from a $YVO_4$ laser. Each mark has a diameter of 2.5 mm. Furthermore, 96 round marks each having a diameter of 2.5 mm have been engraved between the 384 round marks by the $YVO_4$ laser.

Six digits indicating the date of manufacture and three digits indicating the lot number have been engraved along the right fringe of the sample plate by the $YVO_4$ laser. In the example of FIG. 1, nine digits, 060727001, indicating that the plate is the first one manufactured on Jul. 27, 2006, are engraved. Adjacently to the nine digits, a QR (quick response) code that is a so-called two-dimensional code symbolizing the date of manufacture and manufacturer's serial number is engraved. The digits can be read by a reading machine. In this example, a QR code is used. Instead of a QR code, a barcode or mark may also be used. The barcode or mark is used as an identification code for identifying the sample plate.

Information about distortion in the sample plate, i.e., information about the topography of the sample plate representing the positions of the individual spots of the sample, is recorded within the QR code symbolizing the date of manufacture and manufacturer's serial number. When ions created by laser irradiation are accelerated and extracted, the information about the distortion is used to correct the distance between the sample plate 11 and the intermediate electrode 18.

Because the distance between the sample plate 11 and the intermediate electrode 18 is about 3 mm, if there is an unevenness of ±0.1 mm on the sample plate 11, an error of about ±3% is produced in the strength of the accelerating electric field produced between the sample plate 11 and the intermediate electrode 18. Accordingly, information about the topography (distortion) of the sample plate 11 is previously written in the QR code. Before the sample is ionized by laser irradiation, topographic information about the heights of the positions of the sample spots is read from the QR code by the reading machine. The mechanical error in the distance between the sample plate and the intermediate electrode is incorporated in a calculational formula used in calculating the mass-to-charge ratio from the flight times of the accelerated ions. Thus, a mass calibration is performed.

A theoretical calibration actually analyzed from individual parameters including instrumental dimensions and accelerating voltage shows that there is a tendency that as the distance between the sample plate 11 and the intermediate electrode 18 is reduced, the flight time of ions is shortened, and vice versa. This tendency occurs regardless of the kind of ions, the kind of matrix, and the kind of laser. Therefore, where the present embodiment is implemented and spots of a sample placed on convex portions of the sample plate are ionized, a mass calibration is performed in the direction to increase the mass-to-charge ratio, i.e., a correction is made in the direction to increase the flight time. On the other hand, where spots of the sample placed on concave portions of the sample plate are ionized, a mass calibration is performed in the direction to reduce the mass-to-charge ratio, i.e., a correction is made in the direction to shorten the flight time.

With this configuration, a correct flight time can be obtained based on a correct electrode interval because distortion in the sample plate 11 has been corrected. Consequently, mass-calibrated, accurate mass-to-charge ratios of ions free of mechanical errors can be found.

The information about the distortion (topographic information) in the sample plate may not be directly held on the surface of the sample plate by laser engraving. Rather, the information may be registered as an electronic file in a storage device, such as a hard disk, within the mass spectrometer such that the file corresponds to the identification information about the sample plate. When the identification information on the surface of the sample plate is read by the reading machine, the electronic file may be directly read from the storage device based on the identification information.

Figure 2:
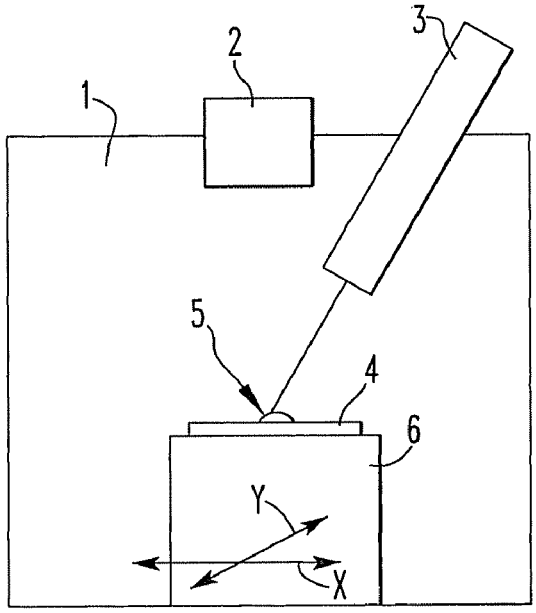
FIG. 2 is a vertical block diagram of a MALDI ion source, according to the present invention.

FIG. 2 shows one embodiment of a MALDI ion source, according to the present invention. The ion source has a vacuum chamber 1 in which an X-Y stage 6 is mounted. The sample plate 4 is placed on the stage 6. A device 2 (e.g., a CCD camera) for observing the surface of the sample plate and reading the ID information is mounted opposite to the X-Y stage 6. When the X-Y stage 6 is moved in the X- and Y-directions, the observing and reading device 2 reads the ID information about the sample plate 4.

The observing and reading device 2 reads the QR code in which distortion information about this specific sample plate is recorded after reading the ID information about the sample plate 4. At the same time, spots of sample 5 dripped into the round marks on the surface of the sample plate 4 are observed.

As described previously, with respect to the information (topographic information) about distortion in the sample plate 4, the QR code may not be directly stored on the surface of the sample plate 4 by laser engraving but may be registered as an electronic file in a storage device (not shown) such as a hard disk within the mass spectrometer while made to correspond to the ID information about the plate 4. When the ID information on the surface of the sample plate 4 is read by the observing and reading device 2, the electronic file may be directly read from the storage device based on the ID information read out.

A laser 3 for ionizing the spots of sample 5 is placed at a position slightly shifted from the axis connecting the observing and reading device 2 and the X-Y stage 6 on the wall surface of the vacuum chamber 1 on which the observing and reading device 2 is mounted. The surface of each sample spot 5 is irradiated with the light from the laser 3. As a result, the sample spot 5 is ionized or vaporized.

The intermediate electrode and base electrode necessary to create an accelerating electric field for extracting the created sample ions from the surface of the sample plate 4 toward the analyzer of the mass spectrometer are omitted from FIG. 2 to simplify the illustration showing the main portions.

It is to be noted that FIG. 2 is merely a conceptual diagram. Obviously, the positional relationships among the observing and reading device 2, laser 3, sample plate 4, and X-Y stage 6 can be modified variously by using lenses, mirrors, and other components in appropriate combinations.

Figure 3:
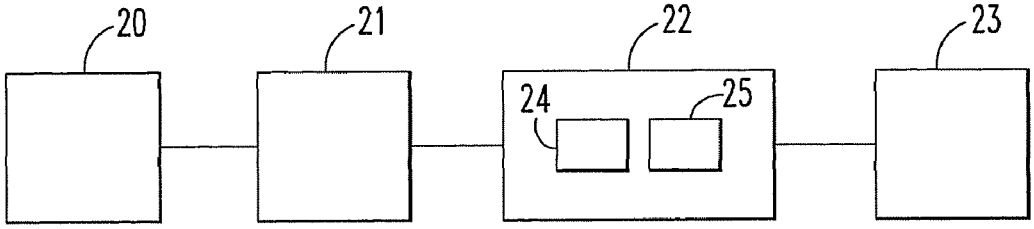
FIG. 3 is a block diagram of a mass spectrometer according to the present invention.
Figure 4:
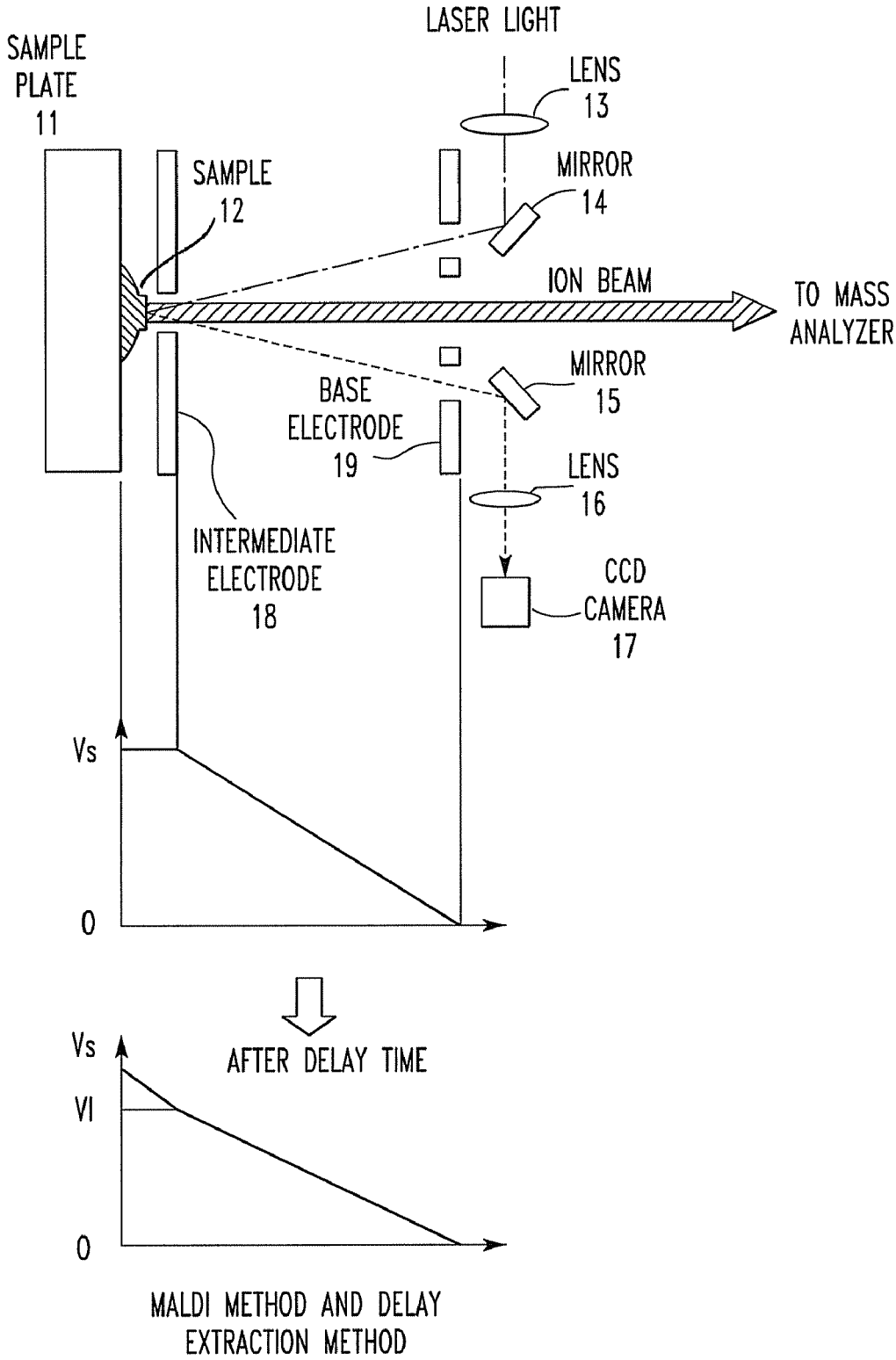
FIG. 4 is a schematic diagram of one conventional MALDI ion source.

In the mass spectrometer, according to the present invention, as shown in FIG. 3, a mass analyzer 21, such as a time-of-flight mass analyzer, for measuring mass spectra of ions is mounted behind a MALDI ion source 20. A data-processing portion 22, such as a computer, for calibrating the mass spectra obtained by the mass analyzer 21 in terms of mass is mounted behind the mass analyzer 21. A storage portion 23, such as a hard disk, for storing the resulting data together with sample images and image-recognized sample plate ID is mounted behind the data-processing portion 22.

The distortion information (topographic information) about the sample plate is stored in the storage portion 23 such that the distortion information corresponds to the ID information about the sample plate. When the ID information about the sample plate is read by the reading machine, the distortion information is read from the storage portion 23 into the data-processing portion 22 based on the ID information read out and used for mass calibration of the mass spectra obtained by the mass analyzer 21.

First and second software programs 24 and 25 are loaded in the data-processing portion 22. The first software program 24 is used to decode the ID code on the surface of the sample plate 4 that is observed and image-recognized and to store the decoded ID code into the storage portion 23 in combination with data obtained by a measurement or an analysis. The second software program 25 is used to calibrate the mass spectra in terms of mass from the barcode, QR code, mark, or information stored in the storage portion 23 regarding distortion in the surface of the sample plate 4. The present embodiment is used in the following sequence:

1. A mixture solution 5 of the sample and matrix is dripped according to the marks on the sample plate 4.

2. The sample plate 4 is introduced into the vacuum chamber 1 of the mass spectrometer and held on the X-Y stage 6.

3. The barcode or QR code on the introduced sample plate 4 is observed by the sample plate ID code observing and reading device 2 and the ID code of the plate is read. At this time, information about distortion in the sample plate 4 may also be read simultaneously.

4. The sample plate 4 is moved in the X- and Y-directions using the X-Y stage 6 while observing the surface of the sample plate 4 by the observing and reading device 2. In this way, a desired dripped spot of the sample 5 is searched for.

5. The sample spot 5 is irradiated with light emitted from the laser 3 to ionize the sample spot 5. A measurement for mass analysis is started in the mass analyzer of the mass spectrometer.

6. Based on the result of the reading of the barcode or QR code in which information about distortion in the sample plate 4 is recorded, the mass spectra obtained by the mass analyzer are calibrated in terms of mass using the software program ancillary to the data-processing portion of the mass spectrometer. Also, sample images and image-recognized sample plate ID codes are stored and combined with data obtained by the measurement or analysis. The resulting data is stored in the storage device such as a hard disk.

6'. As a different method, information about distortion in the sample plate 4 is previously made to correspond to the information about the plate ID and registered as an electronic file in the storage device, such as a hard disk. Corresponding distortion information is read out as an electronic file from the plate ID information read out. The mass spectra obtained by the mass analyzer are calibrated in terms of mass using the software program ancillary to the data-processing portion of the mass spectrometer. Sample images and image-recognized sample plate ID information are combined with data obtained by a measurement or analysis and stored in the storage device, such as a hard disk.

7. The X-Y stage is moved. Similar operations are performed on another spot of the sample 5. Measurements for mass analysis are continued.

8. After completion of all the measurements for mass analysis, the sample plate 4 is taken from inside the vacuum chamber 1 of the mass spectrometer. The sample plate ID code of the plate 4 is read at a storage location, put into memory, and stored there.

In this way, a barcode, QR code, or mark in which a sample plate ID code or information about distortion in the sample plate is recorded is directly engraved in the conductive sample plate used in a MALDI process. This permits individual management of sample plates. As a result, during storage of samples, their confusion and loss can be avoided.

Furthermore, information about sample plates under measurement is automatically recognized. The recognized information is recorded together with data obtained by measurements. This facilitates judging sample plates used for the measurements.

In addition, mass spectra can be calibrated in terms of mass, based on information about distortion in the sample plates.

The present invention can find wide applications in mass spectrometers equipped with MALDI ion sources.

Having thus described our invention with the detail and particularity required by the Patent Laws, what is desired protected by Letters Patent is set forth in the following claims.

The invention claimed is:

1. A mass spectrometer equipped with a MALDI ion source structured to receive a sample plate and a mass analyzer adapted to perform mass analysis by ionizing spots of a sample adhered at different locations on a surface of a sample plate by irradiating the spots of the sample with laser light in turn to ionize the spots of the sample and introducing obtained sample ions into the mass analyzer to obtain mass spectra of the spots of the sample, means for observing the spots of the sample adhered at different locations on the surface of the sample plate, a data processing portion having associated memory with a stored program for processing data derived from the mass spectra and calibrating said data according to spot position on and topography of the sample plate, and reading means, wherein a code or mark indicating identification information about the sample plate is formed on the surface of the sample plate such that the code or mark can be read by reading means, and wherein the identification information about the sample plate read by the reading means is combined with the data derived from the mass spectra and stored in memory.

2. A mass spectrometer equipped with a MALDI ion source as set forth in claim 1, wherein observation means for observing the spots of the sample adhering at the different locations on the surface of the sample plate acts as said reading means.

3. A TOF mass spectrometer equipped with a MALDI ion source as set forth in any one of claims 1 and 2, wherein the data processing portion has a stored program such that the mass spectra obtained from the spots of the sample adhering at the different locations on the surface of the sample plate are calibrated in terms of mass by previously registering the identification information about the sample plate and information about topography of the surface of the sample plate while the identification information and the information about the topography are made to correspond to each other by reading the information about the topography of the surface of the sample plate from a storage device based on the identification information about the sample plate read by said reading means to find information about the heights of the locations at which the spots of the sample adhere, and calibrating the mass spectra in terms of mass based on the found information about the heights.

4. A TOF mass spectrometer equipped with a MALDI ion source as set forth in any one of claims 1 and 2, wherein codes or marks indicating information about the topography of the surface of the sample plate are formed on the surface of the sample plate such that the codes or marks can be read by said reading means, and wherein the data processing portion has a stored program such that information about the heights of the locations at which the spots of the sample adhere is found based on the information about the topography of the surface of the sample plate read by the reading means and mass spectra obtained from the spots of the sample adhering at the different locations of the surface of the sample plate are calibrated in terms of mass based on the found information about the heights.

5. A TOF mass spectrometer equipped with a MALDI ion source structured to receive a sample plate and a mass analyzer adapted to perform mass analysis by causing spots of a sample to adhere at different locations on a surface of a sample plate, irradiating the spots of the sample with laser light in turn to ionize the spots of the sample, introducing obtained sample ions into the mass analyzer to obtain mass spectra of the spots of the sample, and processing data derived from the mass spectra by means of a data-processing portion, said mass spectrometer further comprising:

codes or marks formed on the surface of the sample plate to indicate information about topography of the surface of the sample plate; and reading means for reading the codes or marks, wherein said data-processing portion has a stored program such that it calibrates the mass spectra obtained from the spots of the sample in terms of mass, based on the information about the topography of the surface of the sample plate read by the reading means.

6. A TOF mass spectrometer equipped with a MALDI ion source as set forth in claim 5, wherein said data-processing portion has a stored program such that it finds information about heights of said individual locations based on information about topography of the surface of the sample plate read by said reading means and performs mass calibration of the mass spectra based on corresponding sets of the found information about the heights.

7. A TOF mass spectrometer equipped with a MALDI ion source as set forth in any one of claims 5 and 6, wherein a code or mark indicating information for identification of the sample plate is formed on the surface of the sample plate such that the code or mark can be read by said reading means, and wherein the information about the identification of the sample plate read by the reading means is combined with the mass spectra and stored in memory.

8. A sample plate for use in a mass spectrometer equipped with a MALDI ion source, said sample plate comprising:

marks indicating positions at which spots of a sample are made to adhere; and a code or mark indicating information for identification of the sample plate indicating information about the topography of the surface of the sample plate.

9. A sample plate for use in a mass spectrometer equipped with a MALDI ion source as set forth in claim 8, wherein said code indicating information for identification of the sample plate and said codes indicating information about the topography of the surface of the sample plate are made of a barcode or QR code.

* * * * *